United States Patent [19]

Baumgartner et al.

[11] 4,199,108

[45] Apr. 22, 1980

[54] APPARATUS FOR BUILDING UP AND REPAIRING A REFRACTORY LINING

[75] Inventors: Friedrich Baumgartner; Karl H. Fernow, both of Veitsch; Franz Waisnix; Franz Weiss, both of Vienna; Werner Zach, Veitsch, all of Austria

[73] Assignee: Veitscher Magnesitwerke-Actien-Gesellschaft, Vienna, Austria

[21] Appl. No.: 921,901

[22] Filed: Jul. 5, 1978

[30] Foreign Application Priority Data

Jul. 6, 1977 [AT] Austria ..... 4850/77

[51] Int. Cl.[2] ..... B05B 3/08; B05B 3/10

[52] U.S. Cl. ..... 239/662; 222/240; 239/215; 239/224; 239/683; 226/281

[58] Field of Search ..... 239/662, 683, 215, 223, 239/224; 266/281; 222/240, 242, 274; 198/534, 665, 674, 675

[56] References Cited

U.S. PATENT DOCUMENTS

| | | | |
|---|---|---|---|
| 280,437 | 7/1883 | Armstrong | 239/683 |
| 3,374,956 | 3/1968 | Bazilli et al. | 239/683 |
| 3,885,665 | 5/1975 | Fisher | 198/675 |
| 4,033,514 | 7/1977 | Weiss et al. | 239/683 |

*Primary Examiner*—Robert B. Reeves
*Assistant Examiner*—Michael J. Forman
*Attorney, Agent, or Firm*—Kurt Kelman

[57] ABSTRACT

Apparatus for building up and repairing a refractory lining of an industrial oven or like hot-running vessel comprises a disc rotatable in a horizontal plane in either direction for centrifugally depositing a granular refractory material on a portion of the lining to be built up or repaired, a conduit having an outlet opening above the disc for feeding the granular material thereto, and a drive shaft for the disc and for mixing and conveying elements for the granular material in the conduit, these elements being capable of conveying the granular material to the rotatable disc in either one of the selected directions of rotation of the disc.

5 Claims, 3 Drawing Figures

Fig. 1
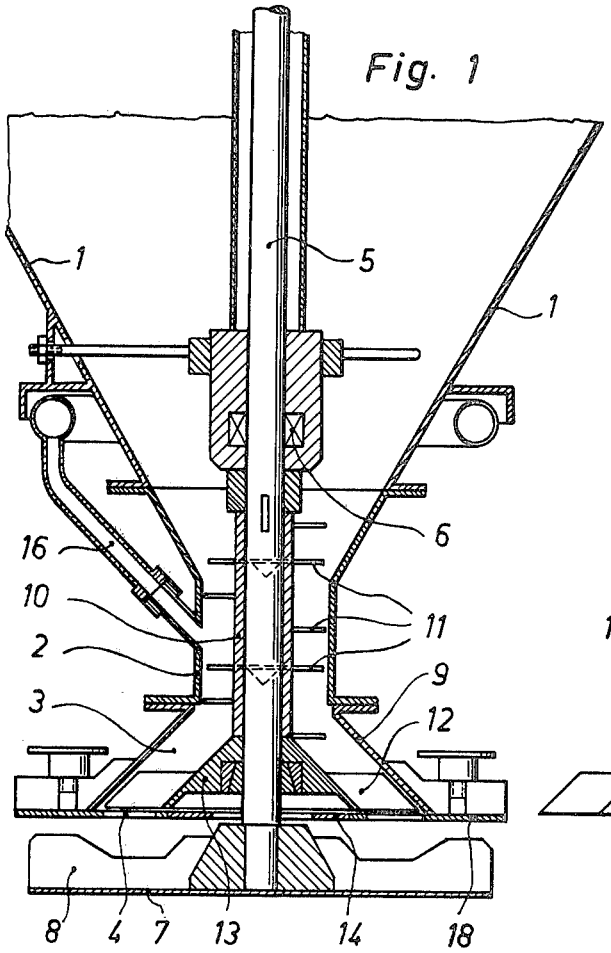
Fig. 2
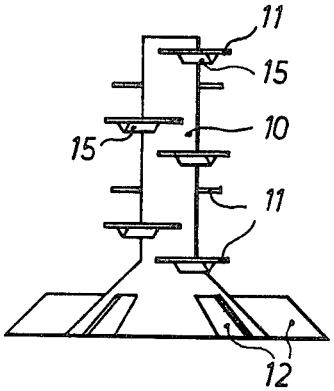
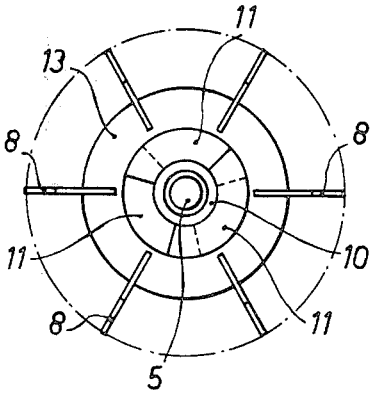
Fig. 3

APPARATUS FOR BUILDING UP AND REPAIRING A REFRACTORY LINING

The present invention relates to improvements in an apparatus for use in, and capable of being lowered into, an industrial oven or like hot-running vessel having a vertically extending refractory lining for building up or repairing a portion thereof.

U.S. Pat. No. 4,033,514, dated July 5, 1977, the joint inventors of which are joint inventors in the present application and whose disclosure is incorporated herein by reference, discloses an apparatus of this type comprising a disc extending in a horizontal plane and rotatable in the plane for centrifugally depositing a granular refractory material on a portion of the lining to be built up or repaired, a conduit for feeding the granular refractory material to the disc, the conduit having an outlet opening above the disc, a stationary cover means over the outlet opening, the cover means having circumferentially distributed outlet ports directed towards the centrifugal disc, and apertured plates slidable into and out of the outlet ports in a radial direction for changing the size and closing the outlet ports. Means for mixing and conveying the granular refractory material are arranged in the conduit. In this known apparatus, sliding of the apertured plates enables the outlet ports to be adjusted in a radial and a circumferential direction, as well as in size. Changing the radial position of the outlet ports makes it possible very accurately to determine the point of impact of the granular material on the lining. Changing the size of the outlet ports will control the amount of centrifugal material per arc unit. However, in the operation of the apparatus, the density of the jet of centrifuged material decreases in the direction of rotation of the disc, i.e. at the beginning of the arc of lining being built up or repaired upon rotation of the disc, more material is ejected than at the end of the arc. This is frequently quite undesirable since the worn-out portions of the lining are often quite different. For instance, the worn-out zones caused by the electric arc immediately in front of the furnace door, seen in the direction of rotation of the disc, can be repaired only with difficulty with the known apparatus because a large part of the centrifuged material would be ejected through the door. Also, when agitators are used to mix a melt in metallurgical furnace, the lining if worn out more strongly in one direction. Differentiated wear of the refractory lining in industrial oven and like hot-running vessels is also caused by the addition of fluxes.

It is the primary object of this invention to provide an apparatus of the indicated type which enables the density of the jet of granular refractory material being ejected by the rotating disc to be controlled.

This and other objects are accomplished in accordance with the invention with a centrifugal disc which is rotatable about an axis in either one of a selected direction of rotation and a drive shaft for the disc and for the mixing and conveying means for the granular material in the conduit, the mixing and conveying means being arranged for conveying the granular material to the rotatable disc in either one of the selected direction of rotation of the disc.

Since the direction of rotation of the centrifugal disc may be selected, i.e. the disc may be driven in either direction, differentially worn-out zones requiring different densities of the ejected material in both directions of rotation may be repaired in a simple manner.

The above and other objects, advantages and features of the present invention will become more apparent from the following detailed description of the now preferred embodiment thereof, taken in conjunction with the accompanying drawing wherein FIG. 1 is an axial section of the apparatus;

FIG. 2 is a side elevational view of the granular material conveying and mixing means in the delivery conduit; and FIG. 3 is a top view of the conveying and mixing means in the direction of the drive shaft.

Referring now to the drawing, there is shown funnel-shaped hopper 1 through which a granular refractory material is to be fed, the narrow end of the hopper being connected to one end of cylindrical pipe 2 whose other end is connected to frusto-conically enlarged conduit 3 of annular cross section and having an annular outlet opening 4. Vertical drive shaft 5 is mounted in bearing 6 and extends coaxially through the feed hopper and conduit, disc 7 being keyed to the drive shaft. Ribs 8 radiate from the hub of the disc and divide the same into a plurality of sectors. The end of the drive shaft opposite to the end carrying disc 7 is connected to a drive motor (not shown), which may be a pneumatically operated motor, to rotate the disc at about 700 to 800 rpm, for example.

Refractory material feed conduit 3 is defined by stationary frusto-conical wall 9 and pipe 2 connected thereto, and concentrically arranged frusto-conical element 13 and cylindrical sleeve 10 keyed to drive shaft 5 for rotation therewith. The drive shaft supports mixing and conveying means for the granular material in conduit 3, the illustrated mixing and conveying means being comprised of segmental plates 11 affixed to sleeve 10, which forms part of the drive shaft, and arranged in a plurality of parallel planes spaced from each other and extending transversely to the drive shaft. One segmental plate is affixed to the shaft in each of the parallel planes and the arc of each segmental plate encloses an angle of 90° to 180°, preferably 120°. The segmental plates overlap each other, viewed in the direction of drive shaft 5. Entrainment elements 15 project from the underside of the plates and the entrainment elements have two entrainment faces converging towards each other in the direction of conveyance of the granular material. The cross section of the entrainment elements in a plane perpendicular to the plane of the segmental plate has the form of an isosceles triangle.

With this preferred embodiment of granular material conveying and mixing means, the material will be conveyed on rotation of shaft 5 by freely cascading from segmental plate to segmental plate and will be entrained by elements 15 while cascading down in the selected direction of rotation . The converging entrainment faces will impart to the conveyed granular refractory material not only the force of gravity but an additional directional component and, due to their symmetry, this will remain unchanged in either direction of rotation. The stream of the material in the direction of conveyance will be controlled in the preferred embodiment illustrated herein by the overlapping arrangement of segmental conveying and mixing plates 11. This prevents the material from dropping too rapidly through delivery conduit 3 and the speed of conveyance through this conduit is further controlled by suitably selecting the arc of the segmental plates, an arc of 90° to 180°, most preferably 120°, providing a very favorable conveying and mixing condition in both directions of rotation.

As shown in FIG. 1, conveyor vanes 12 are affixed to frusto-conical element 13. Such an arrangement will serve to convey the granular material and to mix the material with a wetting liquid in the conduit, which wetting liquid, such as water, is fed to the conduit by tubing 16.

Stationary cover or shield 14 is mounted between annular outlet opening 4 of feed conduit 3 and rotatable disc 7. The cover is star-shaped and has radially extending sectors which are open towards the periphery. Sliding plates 18 are slidable into the open sectors, this arrangement being fully described and illustrated in the above-mentioned patent.

The apparatus operates in the following manner.

The apparatus is transported to the hot oven or vessel by an overhead crane and lowered thereinto to a level predetermined by the level at which the lining is to be repaired. Once in position, the drive motor for shaft 5 is turned on for rotating disc 7 in a selected direction of rotation and refractory granular material is fed into hopper 1 while water or any other suitable wetting liquid is fed through tubing 16. The material will cascade freely from segmental plate 11 to segmental plate 11 and will be accelerated between the plates by the oblique entrainment faces of entrainment elements 15 in the direction of rotation as well as in a vertical direction while being mixed with the wetting liquid. The wetted material will be moved by vanes 12 to the openings in sliding plates 18 through which they will freely fall onto disc 7. As has been fully disclosed and explained in the above-mentioned patent, the size and position of the openings in sliding plates 18 are selected in accordance with the portions of lining to be repaired, those worn-out lining portions being repaired first which, in the direction of rotation of the disc, have more worn-out arcuate sections at the beginning of the arc than towards the end of the arc. Thereupon, the direction of rotation of the motor is reversed and remaining worn-out arcuate lining portions are repaired. In this manner, it is possible according to this invention very simply to repair arcuate worn-out lining portions of different depths. The segmental plates 11 with their entrainment elements 15 work the same in both rotational directions, i.e. they convey and mix the granular material independently of the selected direction of rotation of the disc to assure a delivery of the material to the disc free of clumps.

What is claimed is:

1. For use in an industrial oven or like hot-running vessel having a vertically extending refractory lining, an apparatus capable of being lowered thereinto and comprising (a) a disc extending in a horizontal plane and rotatable about an axis in either one of a selected direction of rotation for centrifugally depositing a granular refractory material on a portion of the lining to be built up or repaired, (b) a conduit for feeding the granular material to the disc, (1) the conduit having an outlet opening above the disc, (c) a mixing and conveying means for the granular material in the conduit, and (d) a drive shaft for the disc and for the mixing and conveying means, (1) the mixing the conveying means being arranged for conveying the granular material to the rotatable disc in either one of the selected direction of rotation of the disc, the mixing and conveying means comprising segmental plates arranged in a plurality of parallel planes spaced from each other and extending transversely to the drive shaft, the segmental plates being affixed to the drive shaft and including entrainment elements projecting from the underside of the plates, the entrainment elements having two entrainment faces converging towards each other in the direction of conveyance of the granular material.

2. In the combination of claim 1, wherein the segmental plates overlap each other.

3. In the combination of claim 1, wherein only one of the segmental plates is affixed to the drive shaft in each one of the parallel planes, the arc of each segmental plate enclosing an angle of 90° to 180°.

4. In the combination of claim 3, the angle being 120°.

5. In the combination of claim 1, wherein the cross section of the entrainment elements in a plane perpendicular to the plane of the segmental plate has the form of an isosceles triangle.

* * * * *